US005370327A

United States Patent [19]

Adamski

[11] Patent Number: 5,370,327

[45] Date of Patent: Dec. 6, 1994

[54] METHOD AND APPARATUS FOR REELING A WOUND WEB ROLL

[75] Inventor: Brian C. Adamski, Edgerton, Wis.

[73] Assignee: Beloit Technologies, Inc., Wilmington, Del.

[21] Appl. No.: 60,171

[22] Filed: May 6, 1993

[51] Int. Cl.[5] ..... B65H 18/16

[52] U.S. Cl. ..... 242/533.1; 242/541.6

[58] Field of Search ..... 242/65, 66, 67.1 R, 242/56 R

[56] References Cited

U.S. PATENT DOCUMENTS

| | | | |
|---|---|---|---|
| 3,116,031 | 12/1963 | Moore et al. | 242/65 |
| 3,743,199 | 7/1973 | Karr et al. | 242/65 |
| 4,179,330 | 12/1979 | Page | 242/65 X |
| 4,905,925 | 3/1990 | Kremar | 242/65 |
| 4,934,619 | 6/1990 | Snygg | 242/56 |
| 4,979,689 | 12/1990 | Snygg | 242/65 |
| 5,026,005 | 6/1991 | Ehrola | 242/65 |
| 5,106,029 | 4/1992 | Ehrola | 242/65 |
| 5,184,787 | 2/1993 | Holzinger et al. | 242/65 |

FOREIGN PATENT DOCUMENTS

| | | |
|---|---|---|
| 0483092 | 4/1992 | European Pat. Off. . |
| 0483093 | 4/1992 | European Pat. Off. . |
| 2012733 | 8/1979 | United Kingdom . |
| WO93/06033 | 4/1993 | WIPO . |
| WO93/06034 | 4/1993 | WIPO . |

*Primary Examiner*—Daniel P. Stodola
*Assistant Examiner*—John P. Darling
*Attorney, Agent, or Firm*—Dirk J. Veneman; Raymond W. Campbell; Gerald A. Mathews

[57] ABSTRACT

A method and apparatus for reeling a traveling web, such as paper produced on a paper-making machine, includes a pair of spaced, horizontally disposed rails for supporting one or more reel spools. One of the reel spools is rotated to bring it up to machine speed. A support drum is moved translationally substantially vertically from beneath the rotating reel spool to engage it along a nip line of contact. The on-coming web is directed into the nip of the rotatably driven reel spool to begin the web reeling process to build a wound web roll. The support drum remains in contact with the wound web roll building upon the reel spool continuously until the desired wound web roll diameter is attained. The reel spool/wound web roll is maintained under the control, or influence, of three forces at all times during the formation of the wound web roll: 1) torque from a drive attached to the reel spool, 2) nip pressure from the support drum, 3) web tension of the web coming onto the driven reel spool. The support drum preferably partially supports the wound web roll at all times during the reeling process, and the wound web roll remains horizontal on the support rails at all times as the wound web roll is formed.

23 Claims, 7 Drawing Sheets

METHOD AND APPARATUS FOR REELING A WOUND WEB ROLL

BACKGROUND OF THE INVENTION

1. Field of The Invention

This invention relates to the reeling of a wound web roll. More particularly, this invention relates to an improved method and apparatus for reeling a wound web roll which is maintained under torsion, nip pressure and web tension substantially at all times during formation. Still more particularly, this invention relates to an improved reel on a paper-making machine, and an improved method of reeling paper onto a reel spool, wherein the reel spool is continuously supported on a pair of spaced, horizontally disposed rails during the reeling process while a support drum nips, and partially supports from below, the paper web roll being wound by substantially vertical translational movement.

2. Description of The Prior Art

The reel on a paper-making machine has not changed conceptually for the past thirty or more years. Such a prior-art type of paper making machine reel is exemplified by the so-called Pope type of reel as shown and described in U.S. Pat. No. 3,743,199. The Pope-type of reel operates satisfactorily, but it and all other prior types of reels have deficiencies which become increasingly significant and harmful to paper quality as the reeling speeds increase and the desired diameters of the finished wound paper rolls become larger.

Thus, in a Pope-type of reel, the new reel spool is initially engaged by a pair of primary arms while the first few wraps of paper web are wound onto the reel spool. The newly started wound web roll is then brought into nipping engagement with a support drum while the on-coming paper web continues to be wrapped into a new wound roll. As the wound paper roll begins to increase in diameter, it is rotated by the primary arms about the periphery of the support drum and transferred onto a pair of substantially, horizontally disposed support rails. On almost all existing Pope-type reels, torque either was not, or could not, be applied to the reel spool while it was held in the primary arms. When the reel spool has been rotated down to be supported on the support rails, a pair of secondary arms then maintain the wound paper roll in nipping engagement with the support drum with the nip in a substantially horizontal plane through the rotational axis of the paper roll being wound. Torque is applied to the wound paper roll being wound generally after it has been transferred to the secondary arms.

The wound paper roll thus follows a complicated, non-smooth path from the location where the on-coming web is initially wrapped onto the new reel spool, to the point where it is brought into a nipping engagement with the support drum and is then rotated downwardly about the periphery of the support drum by the primary arms, to the point where it is supported by the support rails and is moved horizontally on the rails as its diameter builds.

This complicated path causes difficulty in that it limits the time during the wound roll building process when center-wind torque can be applied to the reel spool. To optimize wound paper roll structure, torque must be provided to the developing roll from the beginning. Mechanisms which provide torque through the primary arm rotation, such as shown and described in Patent DE 40 07 329 A 1, are complicated, costly and may do more harm than good if there is no compensation for the weight of the mechanism. Further, if torque has been applied to the reel spool while it is supported in the primary arms, the Pope-type reels require that there be a torque transfer to the reel spool of the developing roll when it is transferred from the primary arms onto the support rails and is engaged by the secondary arms to provide nip pressure against the support drum.

Thus, in prior-art reel arrangements, torque is applied either intermittently or when the wound roll is engaged by the secondary arms. Nip pressure is applied substantially by gravity while the roll is supported in the primary arms, and is supplied by hydraulically or pneumatically actuated mechanisms while the roll is supported in the secondary arms. Finally, without a highly wrapped roll, nip, or other tension isolating mechanism between the reel and upstream processes, the sheet/web tension required for good roll structure may be unattainable due to runability problems.

A further deficiency in prior reeling arrangements resides in the fact that the paper roll being wound is supported solely by its reel spool journals on the support rails during the intermediate and final stages of its formation when its diameter and weight are both increasing. Paper wound onto the new reel spool at the beginning of the reeling operation tends to burst, tear, wrinkle and exhibit other defects as the wound paper roll diameter, and pressure exerted near the core, increases and the web tension and wound roll weight increase and the reel spool deflects. This deflection also creates a non-uniform nip distribution across the face of the wound web roll. This non-uniformity creates further problems in turn-up efficiency and in paper defects. Such defects currently cause losses amounting to 1%–5% of the total production of a paper making machine.

When the initial paper web wraps on the reel spool, or core as the reel spool is sometimes called, are not tight enough, there is layer-to-layer slippage. Wound paper rolls must be structured properly, in terms of web tension at different radial distances from the reel spool, to avoid inducing web defects during the reeling operation. It is imperative that the initial paper web wraps on the reel spool/core be tight enough to avoid layer-to-layer slippage and bursting. At the same time, the wound-in-tension must not exceed the web sheets' tensile strength. Radial strains induced by each subsequent web wrap reduces the wound-in-tension of the layer beneath it. Each wrap throughout the wound web roll should be wound with slightly less tension than the previous wrap to minimize this effect. Abrupt changes in roll hardness must also be avoided to eliminate sheet defects within the roll.

It is known that the three parameters influencing wound roll hardness are 1) the torque applied to the spool/core, 2) the linear nip pressure between the wound web roll and the support drum, 3) the tension in the on-coming web being wound into the roll. Existing reels use complicated, expensive, yet sometimes ineffective, control schemes to provide nip pressure between the wound web roll and the support drum. The use of two sets of loading arms (i.e. primary and secondary arms) while moving the wound web roll through an abruptly changing path of travel as it is being wound exacerbates, if not causes, this difficulty. The abruptly changing path of wound roll travel also limits the use of center-wind torque on the reel spool in such apparatus.

Typically, in existing reels, drives have been used only while the roll builds on the horizontal, linear rails after several centimeters of web have built up on the reel spool. In order to optimize the structure of the wound web roll, torque must be provided continuously to the reel spool from the beginning of the reeling operation.

In some applications, such as when reeling creped or carbonless copy paper grades, low levels of nip pressure must be provided to prevent damage to the paper product. On conventional Pope-type reels not having center-wind torque, the low nip pressures required to prevent damage to creped and carbonless copy paper does not provide enough friction to drive the web roll being wound.

SUMMARY OF THE INVENTION

This invention obviates the deficiencies discussed above regarding existing, prior art types of reels. In this invention, the empty reel spools to be wound into wound web rolls are stored in tandem array and are aligned on the same support rails on which the reel being wound into a web roll is supported. Thus, empty reel spools need not be stored, retrieved, handled and positioned from different heights relative to their support position in the reeling apparatus when they are reeling a wound web roll.

The reel spool being wound is supported horizontally on a pair of spaced, horizontally extending support rails at all times during the reeling process. These same support rails support the supply of new reel spools to be wound into subsequent rolls of web material, such as paper. During the reeling process, a support drum engages the wound web roll from below, which reduces the pressure on the paper near the reel spool, or core, by as much as 40 percent, by partially supporting the weight of the wound web roll.

The support drum is mounted for substantially vertical translational movement to engage the web as it is being wound into a wound roll on a reel spool. The on-coming web has its web tension controlled upstream of the support drum and is then directed over an arcuate segment of the support drum surface and is wrapped onto the roll being wound between a pressure nip line of contact between the support drum and the wound web roll.

The angle of support between the wound web roll and the support drum, as measured downwardly from a horizontal plane through the wound roll axis, is variable, as desired. This permits the formation of a more uniform nip pressure profile as the wound roll deflects with increasing web build-up.

At the beginning of the winding process, a fresh reel spool is rotatably supported on the support rails in an upstream portion of its initial position. Torque is applied to the reel spool to bring it up to speed. At some predetermined point, the reel spool is moved a short distance to a downstream portion of its initial position where it is brought into nipping engagement with the support drum. This causes the drum to move downward against its upwardly biased support force, disengaging the nip between the finished roll and support drum. The on-coming web is then directed onto the new reel spool in the downstream portion of its initial position where it remains rotatably supported on the support rails. The web is tensioned simultaneously with the first wrap of the web onto the reel spool. At this point where the on-coming web is initially applied to a fresh reel spool, the reel spool is preferably located in its initial position upstream of the support drum as measured in an upstream direction relative to a vertical plane through the axis of the support drum.

When the newly started roll has begun to be wound, any finished roll is moved along the horizontal support rails to a braking position from which it is eventually removed from the reeling apparatus. The newly begun wound web roll is passed over the top of the support drum to the desired winding angle while supported partially on the support rails where it is continuously engaged and partially supported by the support drum along a nip pressure line with the on-coming web nipped in-between from its initial position when the on-coming web is wrapped onto the reel spool, to the end of its winding position when the wound web roll has reached its desired finished diameter. Both the support drum and the reel spool on which the on-coming web is being wound are driven. Also, the on-coming web is controllably tensioned over the surface of the support drum, so the reel spool being wound into a new wound web roll is maintained under torsion, nip pressure and web tension at all times from virtually the initial wrap of the web onto the new reel spool until the wound web roll reaches its desired final diameter.

The elevation of the reel spools, from the time they are positioned for storage on the support rails to the time the finished wound web roll is removed from the brake station, is unchanged throughout the reeling cycle. Further, the wound web roll is partially supported by the support drum while it is being wound. Since the reel spool is subjected to torque and web tension from substantially the time the on-coming web is applied to a new reel spool to the time when the wound web roll reaches its desired final diameter, and since it is nipped and supported thereafter by the support drum without interruption during its formation, the wound web roll structure can be controlled very well.

The pressure nip between the support drum and the wound web roll is sensed by load cells associated with either the translational support of the support drum or with the supported ends of two pair of spaced, parallel carriage beams which are pivotally mounted near the downstream ends of the support rails and which support the carriages for translationally moving the reel spools on the support rails. The load cells produce signals based on the nip pressure between the support drum and the wound web roll, and the signals are used to control their relative positions and movement. This permits the support drum or the wound web roll, or both, to be loaded along the nip line to provide the desired nip pressure load as the wound web roll increases in diameter.

The application of the nip pressure can be made either through a position control of the wound web roll in combination with load control of the support drum or through position control of the support drum in combination with load control of the wound web roll. In position control, the position of the rotatably supported reel spool on which the web roll is being wound is controlled, and the support drum is translated substantially vertically to provide the desired nip load.

Accordingly, it is an object of this invention to provide an improved reel, and method, for reeling a web into a wound web roll.

Another object of this invention is to provide an improved reel, and method, for producing a wound web roll having few defects.

Another object of this invention is to provide an improved reel, and method, wherein the torque, nip pressure and web tension can be applied and controlled to the web roll being wound throughout the entire reeling process without transfers or interruptions for producing a wound web roll.

An object, feature and advantage of this invention is to provide an apparatus and method for reeling a traveling web onto a reel spool where the reel spool is maintained at the same elevation at all times during the reeling operation.

Still another object, feature and advantage of this invention is to provide an apparatus and method for reeling a wound web roll wherein the roll being wound is supported, at least partially, across the width of the roll at substantially all times during the wound roll reeling operation.

A feature of this invention is the option of providing either position control of the fixed wound web roll, with the support drum controlling nip load, or load control of the wound web roll, with the support drum position controlled.

An advantage of this invention is that it provides an apparatus and method for producing quality wound rolls of large diameter.

Other objects, features and advantages of this invention will become readily apparent to those skilled in the art upon reading the description of the preferred embodiments in conjunction with the attached drawings.

DESCRIPTION OF THE PREFERRED EMBODIMENTS

Figure 1:
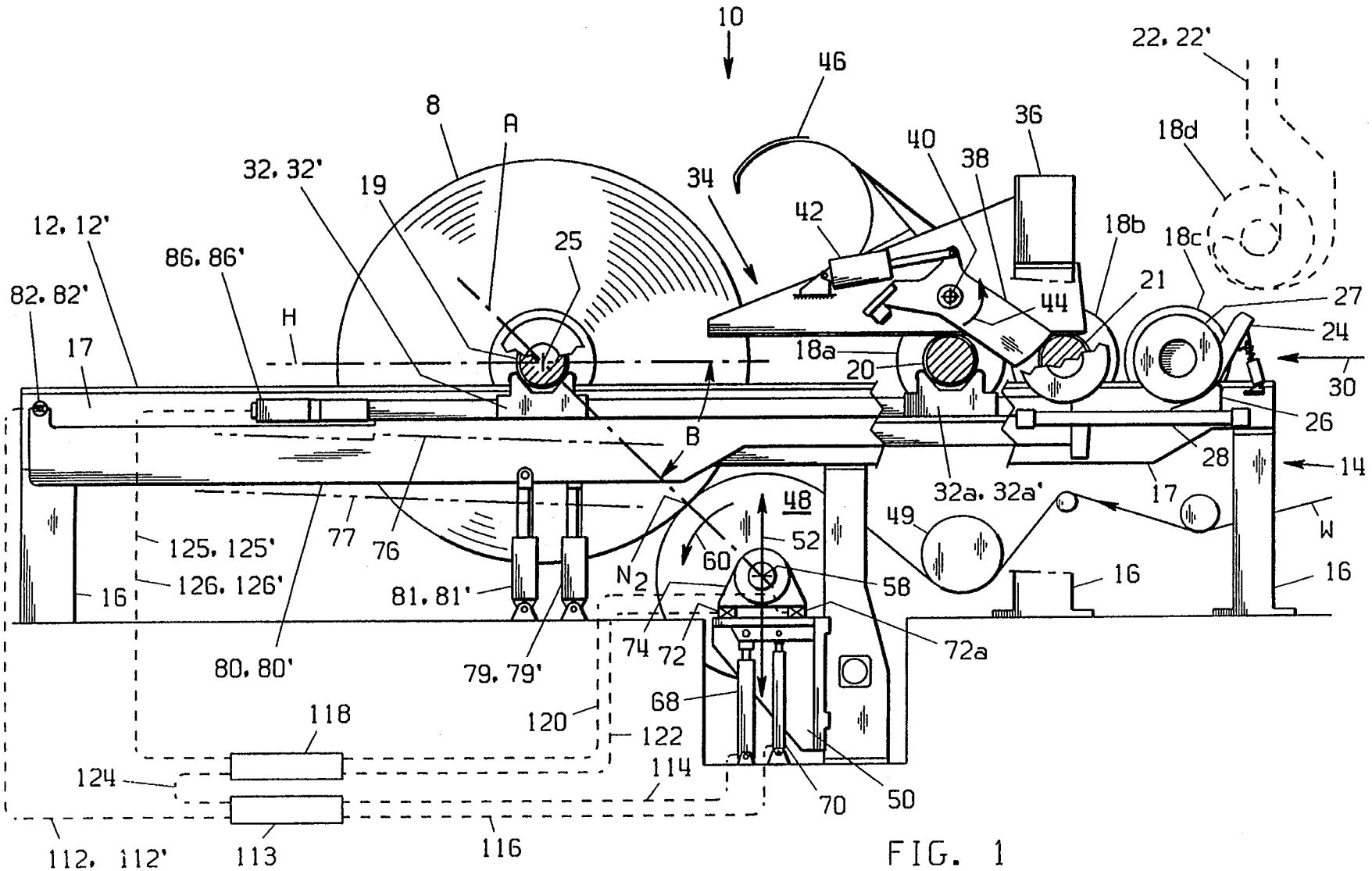
FIG. 1 is a side-elevational View of the new reel showing the reel spool storage and positioning apparatus, and the translational mounting of the support drum.

With reference to FIG. 1, the reel apparatus of this invention, generally designated by numeral 10, comprises a pair of horizontally disposed, laterally spaced, parallel support rails 12, 12' which are mounted on a frame 14 which includes a plurality of frame post members 16 and a rail support beam 17. These rails 12, 12' are also shown in the plan view of FIG. 8. At one end of the reel apparatus, a plurality of empty reel spools **18*a*, 18*b*, 18*c* are supported on the rails with their bearing housings 20, 20'; 21, 21'; 23, 23'**. The bearing housings roll on the rails to permit horizontal translational movement of the reel spools over the rails, but when they are stationary, the reel spool can rotate while supported in its bearing housing.

As shown in phantom lines, a pair of crane hooks 22, 22' is available in the paper mill to load fresh reel spools onto the upstream end of the reel apparatus, which is their storage position, to provide a continuous supply of reel spools for the reeling process. A shock absorbing apparatus 24 is mounted on the far upstream end of the reel apparatus to receive each new reel spool from the crane hooks. A spool insertion device 26, which includes an air operated, rod-less cylinder 28 is mounted on the framework 17 supporting the support rails to move a reel spool translationally, laterally along the support rails. This is accomplished by pushing against an extension shroud 27 at the end of each spool. Such apparatus for moving reel spools is known in the art and, therefore, will not be described further. The plurality of empty reel spools are thus supported in tandem array horizontally on the support rails. The last empty reel spool **18*a* in the downstream direction, according to directional arrow 30, is supported with its bearing housings 20, 20' in a corresponding spool carriage 32*a*, 32*a'*** at either end of the reel spool.

In this description, it is understood that the reel apparatus has two, substantially identical sides, and that the reel spools are similar at both of their ends, so only one side of the apparatus is shown for simplicity, with the understanding that, for example, there is a spool carriage 32, 32' to support the reel spool at either end on either side of the apparatus. A prime mark will be used to distinguish, for convenience, the different ends, or sides, of an item of apparatus, such as a reel spool, and an alphabetical suffix will be used to distinguish, for convenience, between corresponding like items, such as reel spools.

A spool guide apparatus, generally designated with the numeral 34, is mounted on the apparatus from a cross-machine support beam 36 above the reel spools in their storage position near the upstream of the support rails 12, 12'. The spool guide apparatus includes a spool stop 38 mounted to pivot about an axis 40 and is pivoted by hydraulic cylinder 42. By operation of this apparatus in cooperation with the spool insertion device, a reel spool supported in the support carriages on either side of the apparatus is moved translationally horizontally from the storage position to an initial position, while the distal end of the spool stop prevents the next spool **18*b*** from advancing until it is desired to do so. When a new reel spool has been loaded into an empty carriage, which will be explained in more detail subsequently, the hydraulic cylinder 42 is retracted to move the spool stop in the counter-clockwise direction according to arrow 44, so that a new reel spool can be advanced in the downstream direction to be received by a pair of spool carriages which move upwardly from below in a manner which will be explained later.

A web W turn-up device 46 is also mounted on the spool guide apparatus for use in urging an on-coming web W into wrapping engagement with a new reel spool when it is time to begin winding the web onto a new reel spool. The reel spools per se, including their bearing housing; the crane; the spool guide apparatus; the spool stop; and the web turn-up device form no part of this invention and are described only for the purpose of providing an understanding of the conventional aspects of the reel operation on a papermaking machine.

Figure 7:
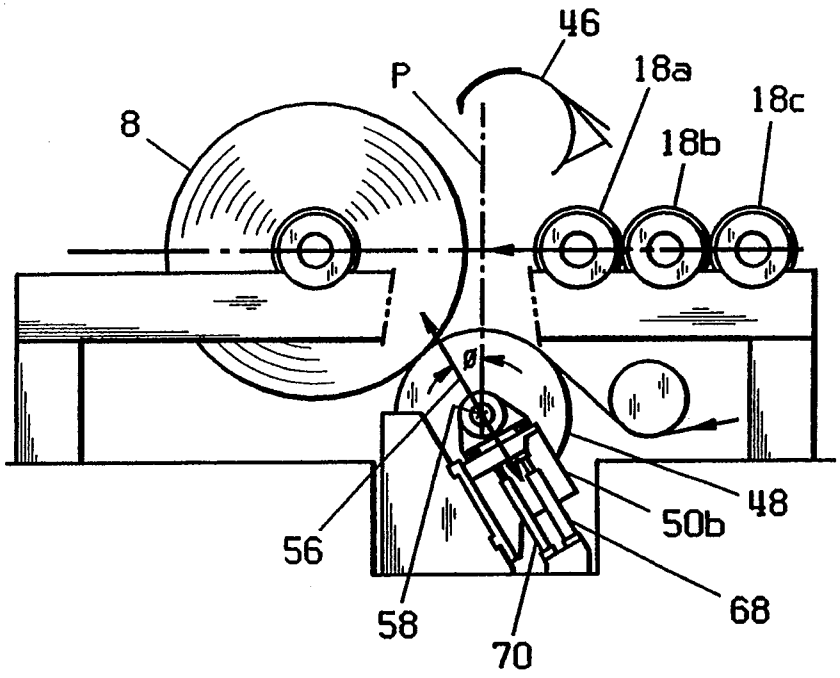
FIG. 7 is a side elevational view of the new reel showing the support drum mounted to move translationally at an angle to a vertical plane.
Figure 6:
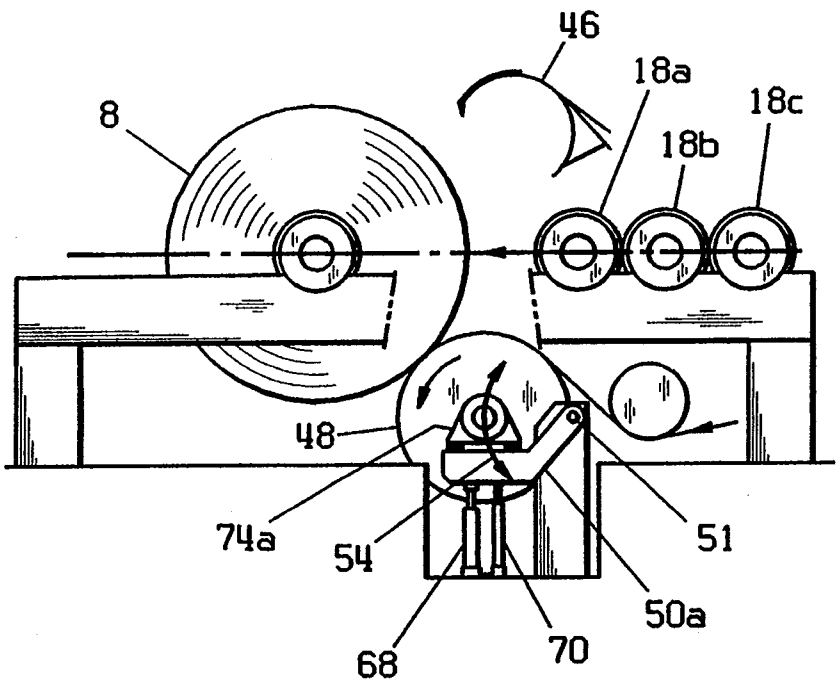
FIG. 6 is a side elevational view of the new reel showing the support drum mounted pivotally to provide its translational movement.

Beneath the framework on which the support rails 12, 12' are mounted is a support drum 48 which is mounted in a translationally movable support frame 50. The translational movement of support drum 48 may either be straight in a substantially vertical direction, as shown by arrow 52, or it may be slightly curved, but also substantially vertical along an arcuate path 54 with the support drum mounted on pivotal frame **50*a* as shown in FIG. 6. Alternatively, the translational movement of the support drum can be straight in the direction of arrow 56, but at an angle $\phi$ relative to a vertical plane P through the axis of rotation 58 of the support drum mounted in angularly arranged support frame 50*b*. This movement in the direction of arrow 56 is considered to be substantially vertical. This is shown in FIG. 7**.

Figure 9:
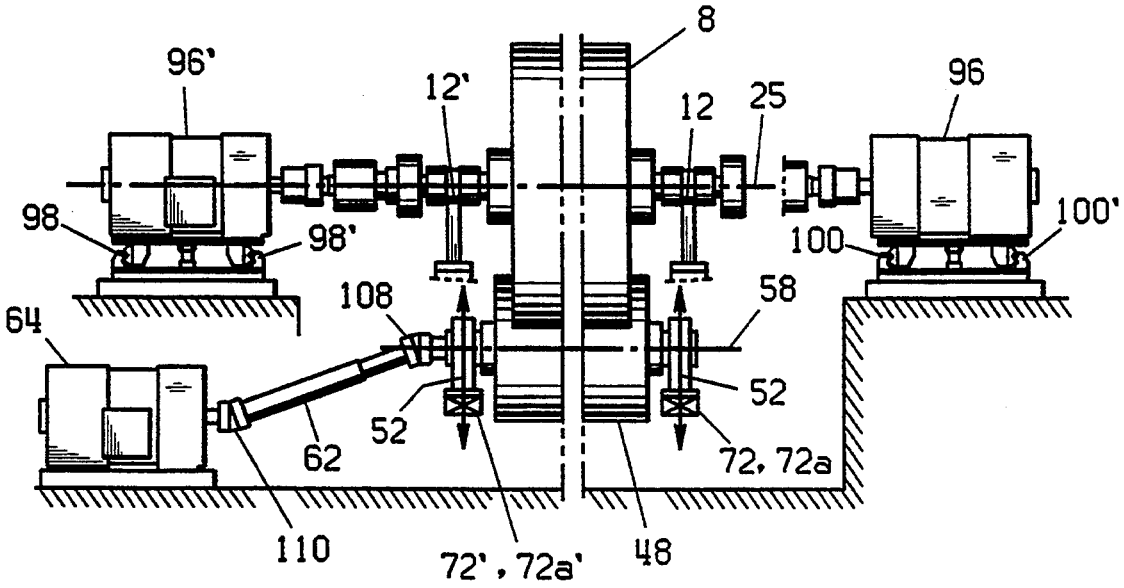
FIG. 9 is an end-elevational view of a drive arrangement at one end of a reel spool along section A—A, as shown in FIG. 8, and also showing the drive arrangement for rotating the support drum.

The support drum 48 is rotatively driven, as shown more clearly in FIG. 9, in the direction of arrow 60 (FIG. 1) by support drum drive shaft 62 which is driven by motor 64. The drive shaft is splined to telescope in and out to accommodate the translational reciprocal movement of the support drum as shown by directional arrows 52. The support drum is rotatively driven at all times when there is a nip present between a newly started reel spool and the support drum, or between the web roll being wound and the support drum, or both.

A pair of hydraulic cylinders 68, 70 are mounted to the frame 50 to move the support drum translationally substantially vertically up and down in the direction of arrows 52, 54, 56. Motor 64 applies torque to the support drum to rotate it in the direction of arrow 60. One or more load cells **72, 72*a*, 72', 72*a*' are mounted between the bearing housing 74 on either side of the apparatus, and the corresponding frame 50. Hydraulic cylinder 68 provides macro movement and force of the support drum, and hydraulic cylinder 70** provides micro movement and adjustments to the nip pressure between the support drum and the wound web roll.

The ends of the support drum 48 on either side of the frame are mechanically linked by a cross shaft 53, as shown in FIG. 1, in order to help maintain vertical alignment as the support drum moves translationally.

Figure 10:
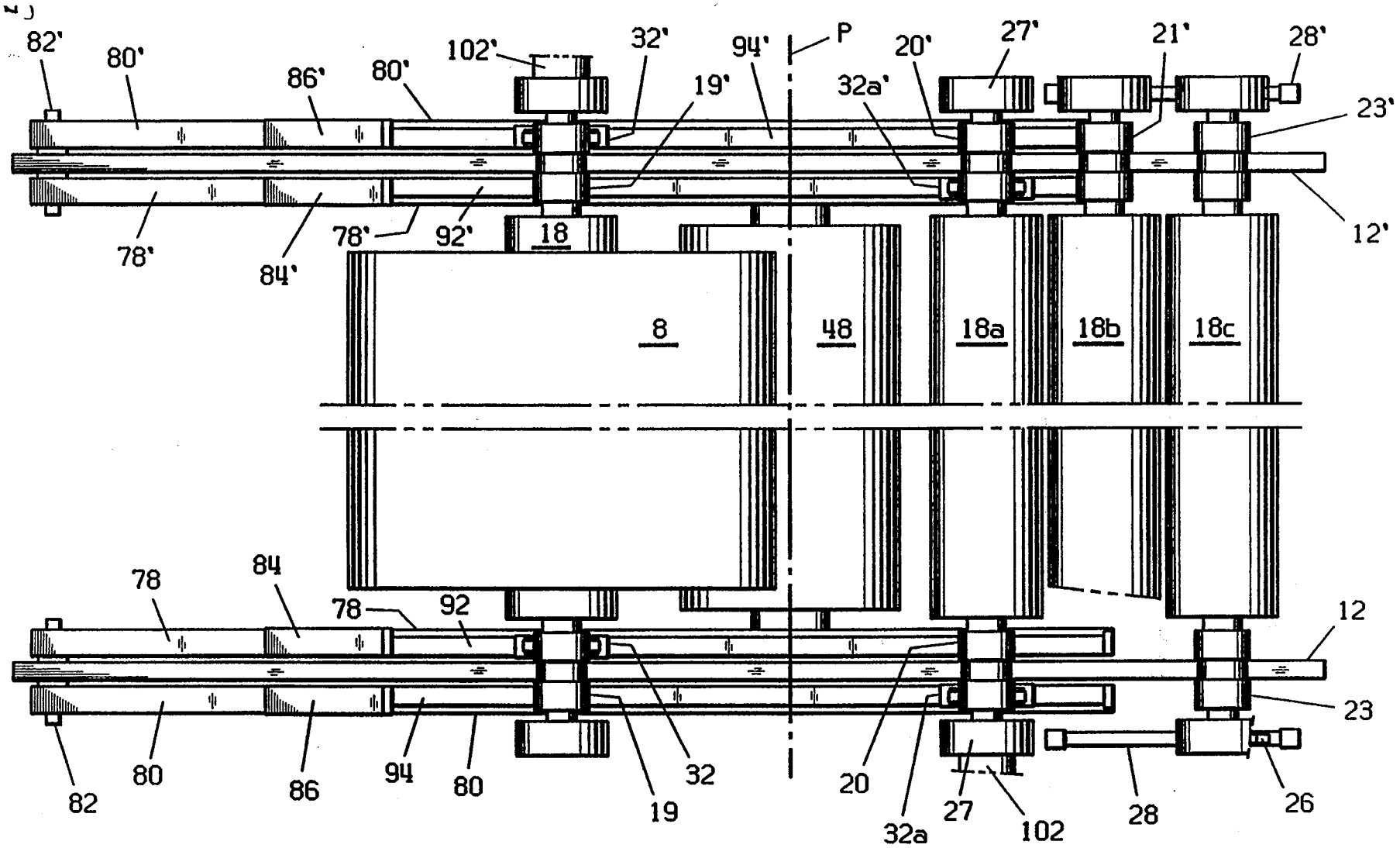
FIG. 10 is a plan view, in somewhat schematic form, showing the pivoted carriage beams for guiding the reel spool supporting carriages during their cycle of operation.

Referring to FIG. 10, a wound web roll 8 is being wound on reel spool 18 and is laterally guided with its bearing housings 19, 19' in a first pair of spool carriages 32, 32'. A fresh reel spool **18*a* has its bearing housings 20, 20' supported in a second pair of spool carriages 32*a*, 32*a*'. Each spool carriage is supported by one of each of an inner beam and an outer beam of an inner or outer pair of support guide beams 78, 78'; 80, 80'; respectively, which are pivotally attached to the rail support beam 17 near the far downstream ends thereof with load sensing pins 82, 82'. Successive reel spools 18, 18*a* have their corresponding ends on one side of the reel apparatus supported in carriages on inner and outer support guide beams on that side of the reel apparatus. Their other corresponding ends are supported in carriages on the outer and inner support guide beams. In this manner, each reel spool has one end supported in a carriage on an outer support guide beam and its other end supported in a carriage on an inner support guide beam. The reason for this preferred arrangement will be explained later. In this manner, alternate pairs of sequentially arrayed spool carriages are translationally supported in sliding contact on pairs of support beams 78, 80'; 80, 78'; respectively. The guide beams 78, 80 normally extend horizontally parallel with rails 12, 12'. However, when a finished wound web roll has been removed from a pair of spool carriages, the guide beams supporting those spool carriages are pivoted downwardly, as shown by broken lines 76, 77 in FIG. 1, by a pair of hydraulic cylinders 79, 79' and 81, 81'attached to each beam of each pair of inner and outer beams 78, 78' and 80, 80'**, respectively.

One guide beam 78, 80 and 78', 80' of each pair of guide beams is pivotally mounted on either side of the rail support beam 17 by a load cell sensing pin 82, 82'. The first pair of spool support carriages 32, 32' are mounted on support guide beams 78, 80', and another pair of spool carriages **32*a*, 32*a*' are mounted on support guide beams 80, 78'. Two pairs of linear actuators 84, 84' and 86, 86' are mounted to the inner and outer support beams 78, 78' and 80, 80', respectively, such that the linear actuators co-extend with the support guide beams. The linear actuators have their reciprocating distal ends 92, 92' and 94, 94'** connected to the spool carriages which are slidably mounted on their corresponding support guide beams. This arrangement permits the horizontal load component of the nip pressure load against the wound web roll to be sensed by the corresponding load sensing pin which, in turn, provides a signal indicative of the horizontal load on the wound web roll and the spool carriages which guide it translationally on the support guide beams.

Figure 8:
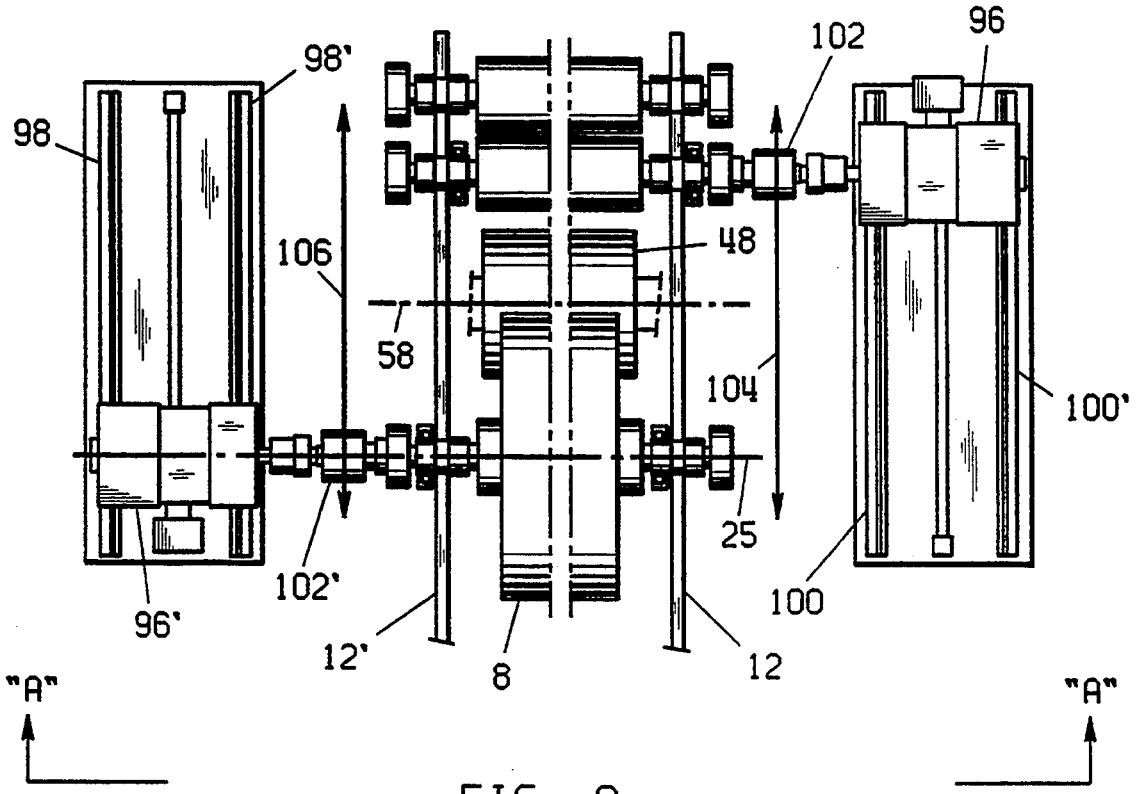
FIG. 8 is a plan view, in somewhat schematic form, showing the manner in which successive reel spools are driven alternately from either end.

With reference to FIGS. 8 and 9, the manner in which successive reel spools are rotatively driven while they are translationally moved along the guide rails is shown. A separate front and back motor 96, 96' is mounted on a pair of spaced rails 98, 98' and 100, 100' for translational movement parallel with the guide rails 12, 12' on which each reel spool is translationally guided horizontally. Each motor has a coupling 102, 102' which extends co-axially with the motor shaft and which can be reciprocated to engage and disengage the end of a reel spool. When engaged, the drive motors provide start-up speed and torque to the reel spool as the reel spool moves translationally along the guide rails 12, 12'. When the reel spool has been wound into a wound web roll having the desired diameter, the drive motor driving that particular reel spool has its coupling disengage the reel spool and the motor reciprocates back to engage the next reel spool which is not being driven by the drive motor on the other side of the reel apparatus. This reciprocal motion is shown by arrows 104, 106.

As shown in FIG. 9, the drive motor 64 for rotatively driving the support drum 48 does not reciprocate, but utilizes a splined drive shaft 62 having a universal joint 108, 110 at either end to provide torque to the support drum while simultaneously permitting the support drum to translate in either a straight line, vertical or at an angle $\phi$ to the vertical, or in an arcuate path 54.

In operation, with particular reference to FIGS. 1–5 and 10, and also with reference to FIGS. 6 and 7, a plurality of reel spools 18*a*, 18*b*, 18*c* are in the storage position of the reel apparatus (FIG. 1 and 2) rotatively supported on the guide rails 12, 12′ at the upstream end of the reel apparatus. Two of the reel spools 18*b*, 18*c* are in the storage position with their bearing housings in rolling support on the guide rails. Reel spool 18*a* is also supported with its bearing housings 20, 20′ in rolling support on the guide rails 12, 12′, but its bearing housings are also engaged by a spool carriage 32*a*, 32*a*′ (FIG. 1) for translational guidance and support on outer and inner guide beams 80, 78′ (FIG. 10).

Figure 3:
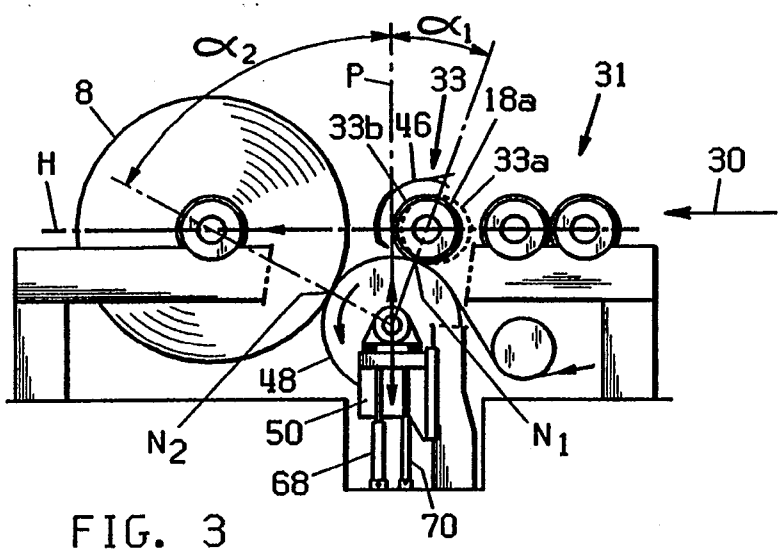
FIG. 3 is a side-elevational view of the new reel, wherein a new reel spool has been moved to an initial position in nipping engagement with the support drum to commence winding the on-coming web into a new wound web roll upon the web roll being wound reaching its desired diameter.
Figure 2:
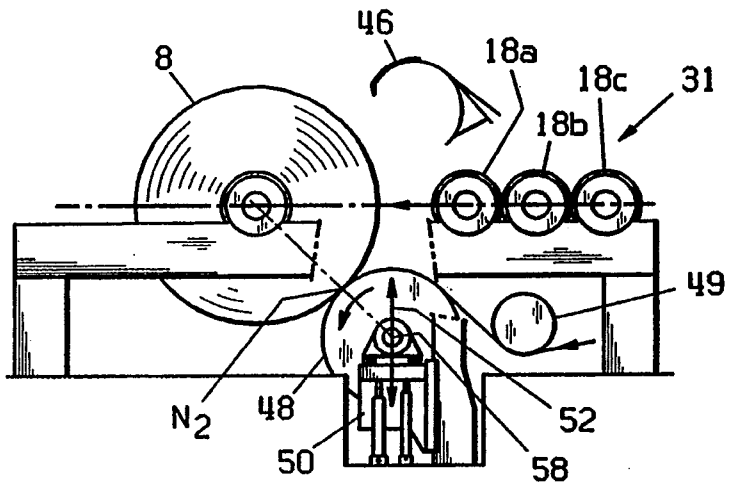
FIG. 2 is a side-elevational view of the new reel showing a web roll being wound and a supply of new reel spools in their storage position.

When either a wound web roll is finished, or a fresh reel spool supported in a carriage is to be started by wrapping the leading end of a traveling web onto the fresh reel spool, the reel spool insertion device 26 moves a fresh reel spool downstream in the direction of arrow 30 from the storage position, designated generally by numeral 31 in FIG. 2, to an initial position, designated generally by numeral 33 in FIG. 3. The initial position 33 actually extends for a short span such as, for example, about 15 cm in length. There is an upstream portion 33*a* and a downstream portion 33*b*. In the upstream portion 33*a* of the initial position 33, the fresh reel spool is not nipped by the support drum 48. In this location, the reel spool is engaged by a drive motor 96, 96′ to provide rotational speed and torque to the reel spool. The pair of support guide beams which is not guiding the carriages supporting the web roll being wound is moved upwardly so that its pair of carriages moves into engagement with the reel spool to guide it substantially horizontally while it is supported on the rails.

The pair of carriages supporting the rotating reel spool 18*a* then laterally move it downstream a short distance to the web transfer portion 33*b* of the initial position where it is nipped at $N_1$ by the rotatively driven support drum as shown in FIG. 3. At this time, in continuous operation, the web is severed upstream of nip $N_1$ and the severed end of the traveling web is guided into nip $N_1$. The turn-up apparatus 46 is activated to pivot downwardly about the periphery of the reel spool to guide the severed web to be wrapped around the fresh reel spool. This is done when the web roll 8 currently being wound has reached its desired diameter. The carriages are moved by the appropriate pair of actuators 84, 86′ or 86, 84′.

Figure 4:
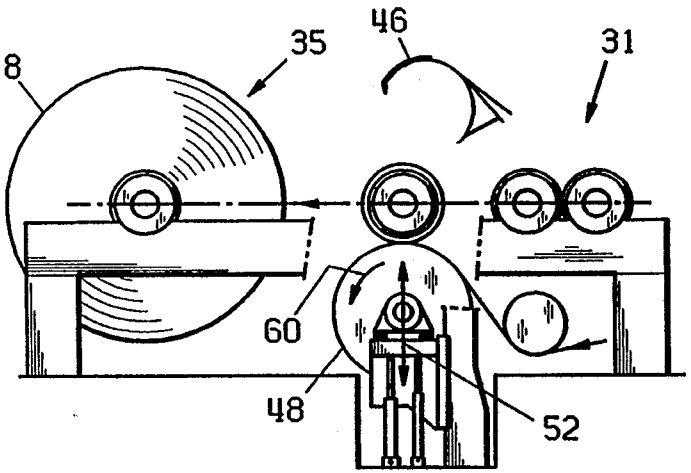
FIG. 4 is a side-elevational view of the new reel showing the new reel spool, on which the web is being wound, moving to the winding position while supported on the rails and in nipping engagement with the support drum.

To effect removal of the wound web roll, the pair of reciprocal actuators linked with the spool carriages 32, 32′ in sliding support on the appropriate inner and outer guide beams 78, 80′ guide the wound web roll 8 to move it away from nip $N_2$ with the rotatively driven support drum and downstream to a braking and removal position, designated generally by numeral 35 in FIG. 4, on the guide rails 12, 12′. Hydraulic cylinder 42 in the spool guide apparatus 34 has retracted the stop 38 to prevent another spool in the storage position from rolling downstream on the rails.

With a fresh spool positioned in a carriage in the web transfer position 33*b* nipped with the support drum 48 at $N_1$ as shown in FIG. 3, as mentioned above, the turn-up device 46 is actuated to pivot downwardly about a portion of the periphery of the spool 18*a* in the downstream portion of the initial position to guide the oncoming web, which has been severed or slashed upstream of nip $N_1$, into wrapping engagement with rotating spool. At about this time, but possibly just prior to, or just shortly after, the turn-up device is positioned over reel spool 18*a*, the wound web roll 8, having reached its desired diameter, is urged downstream in the direction of arrow 30, moving it away from nipping engagement with the drum along nip line $N_2$ by the linear actuators which are linked with that particular pair of spool carriages on either the inner or outer support guide beams. The actuators 84, 86′ or 86, 84′ thus permit the finished wound web roll to disengage from its nip $N_2$ with the support drum and translate horizontally downstream from its winding position to a braking and removal position at the downstream end of the reel apparatus where it is stopped and removed, such as by being lifted by crane hooks 22, 22′. The downward force of nip $N_1$ against the support drum, while the web roll being wound is still being wound, will disengage the wound web roll 8 from its nip $N_2$ with the support drum when the support drum is depressed or lowered by the force of $N_1$ against the biasing force on the support drum.

Figure 5:
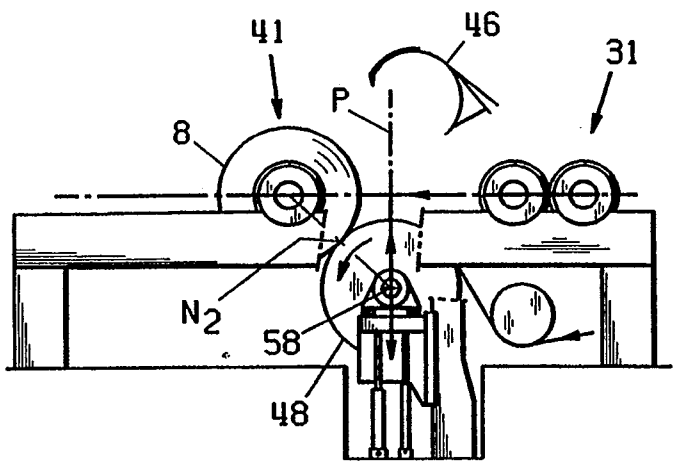
FIG. 5 is a side-elevational view of the new reel wherein the spool on which the web is being wound is in its winding position.

When the finished wound web roll is disengaged from its nip pressure contact $N_2$ with the support drum, the support drum 48 is lowered, such as in the downward direction of arrow 52 shown in FIG. 4, to the extent that the fresh reel spool 18*a* on which the oncoming web has just begun to be wound remains in nip pressure contact with the support drum while the actuators 84, 86′ or 86, 84′, operating on the other pair of support guide beams which are not guiding the just finished wound web roll, are actuated to urge and guide the pair of carriages 32*a*, 32*a*′, on which the reel spool in the initial position is mounted, laterally on the guide beams 80, 78′ over the upper segment of the support drum surface to the winding position, designated generally by numeral 41 in FIG. 5, on the downstream side of a vertical plane through the axis of revolution 58 of the support drum. Thus, while the fresh reel spool is being started in its initial position at nip $N_1$, and then is transferred to its winding position at nip $N_2$, it is constantly in nipping contact with the support drum which moves lower, along any of translational downward paths 52, 54, 56, as in the embodiments shown in FIGS. 1, 6 and 7, to permit the fresh reel spool to move horizontally downstream along its support rails 12, 12′. In the winding position, with the reel spool still supported on the support rails, the newly started wound web roll is maintained in nip pressure contact $N_2$ with the support drum while the wound web roll continues to be wound.

At all times, the wound web roll, from its initial position, during its passage from the web transfer portion of its initial position to its winding position, and during the time the wound web roll is in its winding position, is maintained in nip pressure engagement with the support drum. Also during this time, the drive motor connected to either the front or back side of the reel maintains torque on the reel spool to control the wound-in web tension. The on-coming web W is also maintained under web tension by its travel over roll 49 which produces a tension in the web upstream of support drum 48.

As the newly started reel spool 18*a* moves from its web transfer position in its carriage support (FIG. 3) translationally horizontally downstream in the direction of arrow 30, the turn-up device 46, which had previously been rotated downwardly to initiate the web winding process, is raised out of the way as shown in FIG. 4.

In FIG. 5, the wound web roll continues to be wound in its winding position as designated generally by arrow 41 in nipping engagement with the support drum along nip $N_2$.

With reference to FIG. 6, the support drum 48 could be pivoted, such as having its bearing housing 74*a* mounted on a pivot arm 50*a* which is pivoted on the frame through a pin 51. Its substantially vertical translational movement is therefore along an arcuate path as shown by double headed arrow 54.

With reference to FIG. 7, the support drum frame 50*b* could be mounted on an incline to translate substantially vertically at an angle $\phi$ to a vertical plane P through the axis of rotation 58 of the support drum.

In all of the configurations shown in FIGS. 1–4, 6 and 7, the primary force moving the support drum into and out of position is hydraulic cylinder 68, while a smaller hydraulic cylinder 70 provides variations in the desired nip pressure load once the support drum is in the desired position.

Successive pairs of the carriages supporting the bearing housings at either end of the reel spools are supported in sliding contact with corresponding alternating pairs of support beams 78, 80' and 80, 78'. Therefore, as a wound web roll supported vertically on the horizontal rails 12, 12' is moved from the winding position to the removal position 35 by operation of the appropriate pair of linear actuators 84, 86 which are attached with their reciprocative distal ends 92 or 94 to the carriages and which slide the carriages to the removal position, the other pair of support beams 78, 80' or 80, 78' are pivoted downwardly about the load sensing pins 82, 82' which comprise the pivot pins linking the support beams to the frame support beam 17. This permits the other pair of carriages which are not supporting the finished wound web roll to pass beneath the carriages supporting the just-finished wound web roll and to travel upstream to beneath the initial position. A fresh reel spool is then, or already has been, moved by the insertion device 26 into the first storage position (i.e. spool 18*a* in FIG. 1) which is closest upstream of the upstream portion 33*a* of the initial position at which time the downwardly pivoted pair of support beams is raised so that the fresh reel spool in such first storage position is received in the other pair of carriages to commence the process beginning with moving the fresh reel spool to the upstream portion 33*a* of the initial position for winding a new web roll. The fresh reel spool is moved to the downstream portion 33*b* of the initial position to establish nip $N_1$ by operation of the appropriate pair of actuators 84, 86', or 86, 84'. The traveling paper web is severed by appropriate means, not shown, and the finished wound web roll is removed from the removal position on the support rails 12, 12'.

The nip $N_1$ is established between the fresh reel spool in the web transfer position and the support drum 48. Depending on the desired type of control of nip $N_2$ between the previously wound web roll and support drum 48, the support drum might be either raised or lowered to establish the desired position of nip $N_1$ with the fresh reel spool. The web turn-up apparatus 46 is activated to urge the previously severed on-coming end of the web into a wrapping engagement with the fresh reel spool at nip $N_1$. As the traveling web begins wrapping the fresh reel spool while the nip $N_1$ is maintained, the support drum 48 can be moved vertically downwardly along any of paths 52, 54, 56, according to the embodiment shown in the corresponding FIGS. 1–5, or 6, or 7, respectively, to maintain the nip $N_1$ at a desired pressure. The force of the appropriate actuators 84, 86' or 86, 84' also influences the load of nip $N_1$. Nip $N_1$ is upstream of vertical plane P through the rotational axis 58 of the support drum, and nip $N_2$ is downstream of vertical plane P.

At some predetermined time based on the wound roll diameter, the wound roll is moved downstream from the initial position to the winding position. Its weight is greater than the upward biasing force on the support drum. This combination of lateral movement of the web roll being wound and its weight causes the support drum to be lowered against the force of the pressure cylinder so that the just-started wound web roll can pass over the upper peripheral segment of the support drum surface to the winding position 41 as explained above. The wound web roll is then maintained in nipping engagement $N_2$ with the support drum at a desired nip pressure.

At any time after the newly-started reel spool has moved, or has begun to be moved, from its initial position, the pair of support beams 78, 80' or 80, 78' on which the previously just-wound web roll has moved, or has begun to be moved, to the removal position by the appropriate linear actuators, are lowered after the wound web roll has been removed and those carriages which had been supporting the just-wound web roll are in turn moved forwardly to the initial position by the appropriate pair of actuators 84, 86' or 86, 84'. Thus, it is seen that two pairs of carriages, one pair mounted on each of the corresponding inner/outer and outer/inner pairs of support beams are moved reciprocally on the support beams to receive successive new reel spools to be wound into wound web rolls thereon. Since the pairs of support beams alternately pivot downwardly and upwardly, the pairs of carriages they support do not intersect during their reciprocal movement. When the carriages are lowered, the reel spool they are laterally guiding remains supported on the rails.

The pressure nips $N_1$ and $N_2$ when the wound web roll is in its web transfer and winding positions can be produced and controlled by any of three operating control arrangements utilizing the support drum and carriages. These are position control, load control, or a combination of position and load control.

In the arrangement where the wound web roll carriages 32, 32' are position controlled with the support drum load controlled, one pair of carriages controls the wound web roll's machine direction alignment, its horizontal position, and the winding angle, or angular position, of nip lines $N_1$ and $N_2$ relative to the support drum 48. Such angular positions are angles $\alpha_1$ between vertical plane P through the axis 58 of the support drum and a line between $N_1$ and axis 58, and angle $\alpha_2$ between vertical plane P and a line between $N_2$ and axis 58, as shown in FIG. 3. The preferred actuator for controlling the position of the wound web roll is a precision ball screw, guided by linear roller bearings, in combination with an electric servo/stepper motor. All of these components are shown schematically by actuators 84, 84' and 86, 86'. Other forms of carriage actuation means include, for example, motor driven belts or chains, hydraulic or pneumatic cylinders, and the like. In this arrangement, the support drum 48 is then load controlled to maintain and adjust the level of nip pressure between the wound web roll and the support drum along nip line $N_1$ and $N_2$. The preferred method of actuating the support drum is with hydraulic cylinders 68, 70. Other forms of support drum actuation might include, for example, precision ball screws guided by linear roller bearings in combination with an electric servo/stepper motor, or driven belts or chains, and the like. Load cells 72, 72' or 82, 82' provide feedback so that a controller, such as, for example, an Allen Bradley controller from the PLC 5 family of controllers, varies the hydraulic pressure to cylinders 70, 70' to achieve the desired level of nip pressure. This is the preferred form of control.

In the arrangement where the support drum 48 is position controlled with the carriages 32, 32' or **32*a*, 32*a*' load controlled, one pair of carriages controls the level of nip pressure along either of nip lines $N_1$ or $N_2$. The preferred actuation equipment for controlling the load of the carriages is similar to the load control described above. Also in a manner similar to that described above, load cells 72, 72' or 82, 82' provide feedback so that a commercial servo controller, such as, for example, a controller from the Indromat CLM family of controllers, controls the level of torque output to the ball screws which are, for example, actuating the wound web roll support carriages to maintain the desired nip level along nip lines $N_1$ and $N_2$. The support drum is then position controlled to maintain its position and drum alignment, and to provide the desired angular location of nip lines $N_1$ and $N_2$ about the surface of the support drum. In this arrangement, the preferred method of actuation, or position control, of support drum 48 is by hydraulic cylinders, such as cylinders 68, 70**. Other methods of actuation contemplated include, for example, precision ball screws guided by linear roller bearings in combination with an electric servo/-stepper motor, or motor driven belts or chains, or the like.

In position control of the carriages, the cooperating pairs of linear actuators 84, 86' or 86, 84' are continuously positioned to control the lateral position of the carriages and the wound web roll along the support rails so that the appropriate support guide beams 78, 80' and 80, 78', on which the actuators are mounted (and which guide beams are pivotally secured about load sensing pins 82, 82') to maintain the carriages at the reciprocating or moveable ends 92, 92' or 94, 94' of the load actuators (in which carriages the bearing housings supporting the reel spool of the web roll being wound are supported) at a fixed location laterally along the horizontally arrayed support rails 12, 12'. The load on the support drum, and/or the carriages supporting the reel spool at nip $N_1$, then controls nips $N_1$ and $N_2$. Thus, in the case of nip $N_2$, the appropriate actuators are continuously re-positioned and their extension is incrementally decreased to maintain the desired winding angle relationship between the roll and support drum. The load on the support drum is increased according to a signal received from a measurement device, such as load pin 82. In this manner, the nip $N_2$ is controlled as the wound web roll diameter increases and its lateral location along the support rails is continuously re-positioned.

In a similar manner, nip $N_1$ can be controlled by continuously positioning the carriages supporting the reel spool in the web transfer position at nip $N_1$ and controlling the hydraulic pressure of support drum cylinder 70.

Nip $N_2$ is comprised of horizontal and vertical components. Signals from the load sensing pins are a function of the horizontal component of nip $N_2$ and are passed via lines 112, 112' to a control apparatus 113 such as, for example, a proportional integral differential controller in the Allen Bradley PLC 5 family of controllers, which in turn sends signals via lines 114, 116 to either or both of the hydraulic cylinders 68, 70 to move the support drum translationally substantially vertically along any of paths 52, 54, 56, to maintain, increase or decrease, nip $N_2$ as a function of the diameter of the wound web roll 8. Generally, since the linear actuators 84, 86' or 86, 84' are momentarily, or incrementally, maintaining the lateral position of the reel spools on which the web roll is being wound constant, this will necessitate a gradual downward translational movement of the support drum to maintain the nip $N_2$ the same or at a lesser intensity. Conversely, the substantially vertical position of the support drum could be either maintained or raised in order to raise the nip pressure $N_2$ during the incremental period when the lateral position of the wound web roll is maintained constant and the diameter of the web roll being wound is increasing.

In some instances, it may be desirable to wind the web roll with the vertical position of the support drum 48 fixed by locking the movement of the frame **50, 50*a*, 50*b* of the support drum. This locking can be done either mechanically or by maintaining a constant volume of hydraulic fluid in pressure cylinders 68, 70. The linear actuators 84, 86' or 86, 84' as the case may be, then are activated to urge the wound web roll horizontally in the upstream direction to control the nip $N_2$ against the fixed support drum 48. The desired vertical component of nip $N_2$ is thus measured by load cells 72, 72*a*, or, alternatively, load pins 82, 82', intermediate the bearing housings 74, 74' supporting the support drum and their respective frames 50, 50*a*, 50*b*. Signals produced by the load cells are then sent to a control apparatus 118 via lines 120, 122 or, alternatively, via lines 112, 112' which in such a case would be connected to control apparatus 118 if control of actuators 84, 86 was desired. The control apparatus 118, such as, for example, a proportional integral differential controller in the Allen Bradley PLC 5 family of controllers in turn signals the appropriate linear actuators 84, 86' or 86, 84' via lines 125, 125' and 126, 126'**, respectively to either increase or decrease their force against the carriages laterally supporting the wound web roll to maintain, increase or decrease nip $N_2$ as desired, such as being a function of the diameter of the wound web roll.

While the position control and load control arrangements have utilized signals from the load sensing pins 82, 82' and load cells **72, 72*a***, respectively, it is contemplated, and within the scope of the invention, that either control arrangement could utilize signals from the other load sensing measuring means to control the nip $N_2$. The signal lines would, of course, be rearranged accordingly with the appropriate controller. Thus, in the position control arrangement, the position of the wound web roll is fixed and the horizontal component of nip $N_2$ is measured and changed according to some desired parameter, such as the diameter of the wound web roll. In the load control arrangement, the position of the support drum is fixed and the force against the wound web roll is varied to control nip $N_2$. In the position control arrangement, therefore, the horizontal component of nip $N_2$ is measured to control the nip load. Other parameters which may be used to control nip $N_2$, either alone or in conjunction with other parameters, are, for example, wound-in web tension, torque applied to the reel spool, paper grade and the coefficient of friction between layers of the web.

In combination control, the appropriate pair of linear actuators 84, 86' or 86, 84' are controlled to provide the desired winding angular relationship between the wound web roll and the support drum, and the hydraulic cylinders 68, 70 are controlled to move the support drum substantially vertically translationally up or down to control nip forces along nip lines $N_1$ and $N_2$ against the wound web roll. Control of these components is coordinated such as, for example, by linking control apparatus 113, 118 via line 124 to maintain the location of nip $N_2$ in a plane A through the axis of revolution 25 of the wound web roll at a particular angular location downwardly from a horizontal plane H which intersects plane A through the axis of revolution 25 of the wound web roll. This angle is designated $\beta$. In combination control, which is the preferred control arrangement, not only is the location of the nip $N_2$ infinitely adjustable at angle $\beta$, but the magnitude of nip $N_2$ is also controlled, as desired, such as being a function of the wound web roll diameter.

Accordingly, in combination control, the location of the wound web roll is permitted to migrate slowly in the downstream direction along support rails 12, 12' as the diameter of the wound web roll increases if a constant winding angle $\beta$ is desired. Simultaneously, the location of the support drum is permitted to move translationally substantially vertically downwardly as the diameter of the wound web roll increases. The rate at which movement of either the wound web roll or the support drum moves is a function, for example, of both the diameter of the wound web roll and the nip pressure $N_2$ desired at that particular diameter. However, such movement could, for example, be a function of a desired angle $\beta$, or a combination of wound roll diameter, angle $\beta$ and nip $N_2$.

Figure 11:
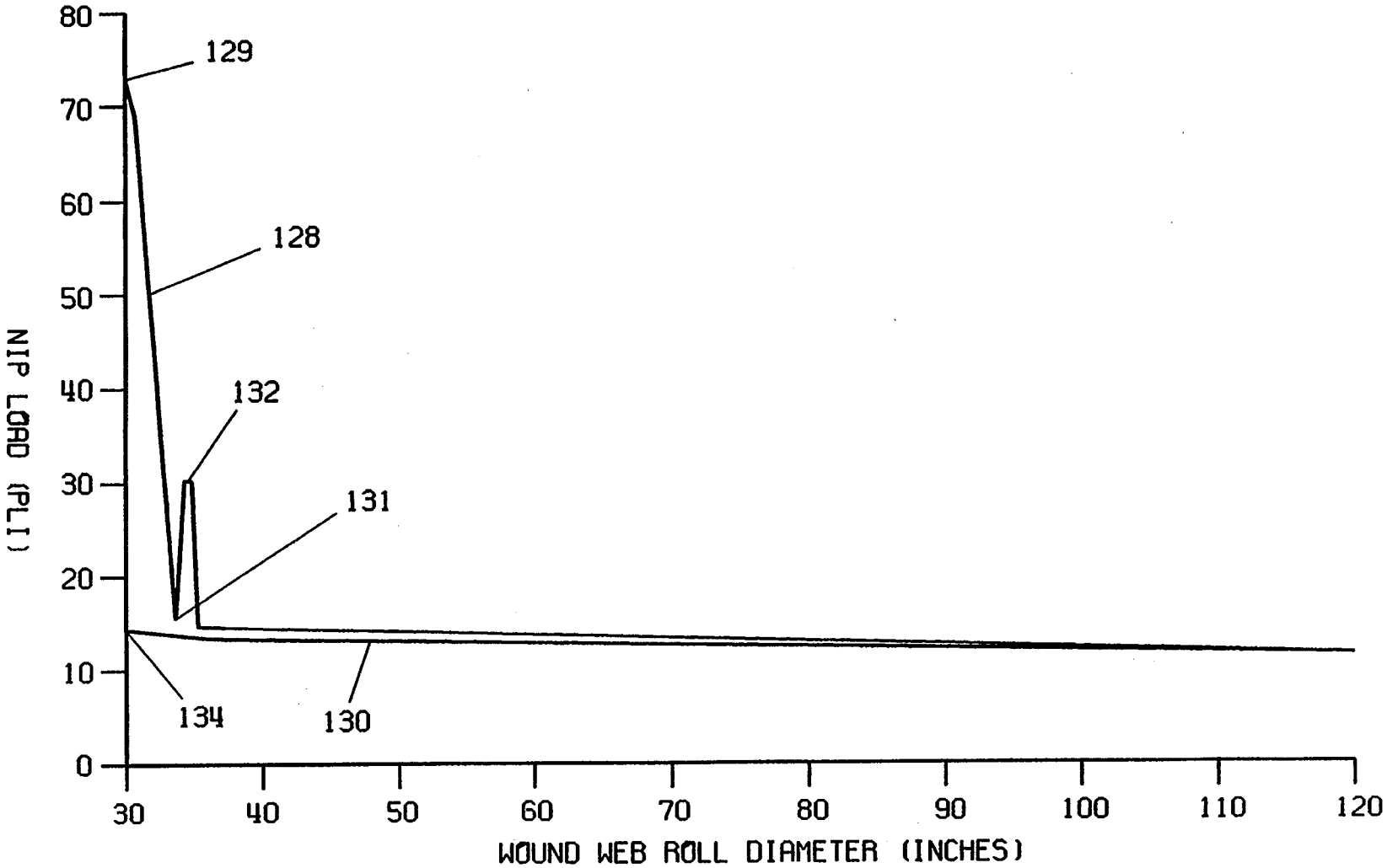
FIG. 11 is a chart showing a comparison between the nip pressure on the wound web roll as a function of its diameter in the new reel and in a prior art Pope-type reel.

Referring to FIG. 11, the nip load of a wound web roll against a support drum as a function of roll diameter is shown for a prior art Pope-type reel, shown as curve 128, and a wound web roll produced by the reel apparatus of this invention, which is shown curve 130. As is readily seen, the initial nip load for the prior art Pope-type reel is initially very high and intense at 129 and then decreases rapidly to a relatively low level 131 momentarily and then almost immediately increases to approximately half of its initial load where it is briefly maintained at 132 before decreasing to a relatively lower level where it gradually decreases to a final lower level. The nip load is erratic and contributes to variations in the wound-in tension in the wound web roll.

By contrast, the nip load of a web roll wound in the reeling apparatus of this invention is initially at a level 134 which is only about 20% of the initial intensity of the nip produced on a Pope-type reel. The nip level then very gradually and smoothly decreases to a final lower level.

Figure 12:
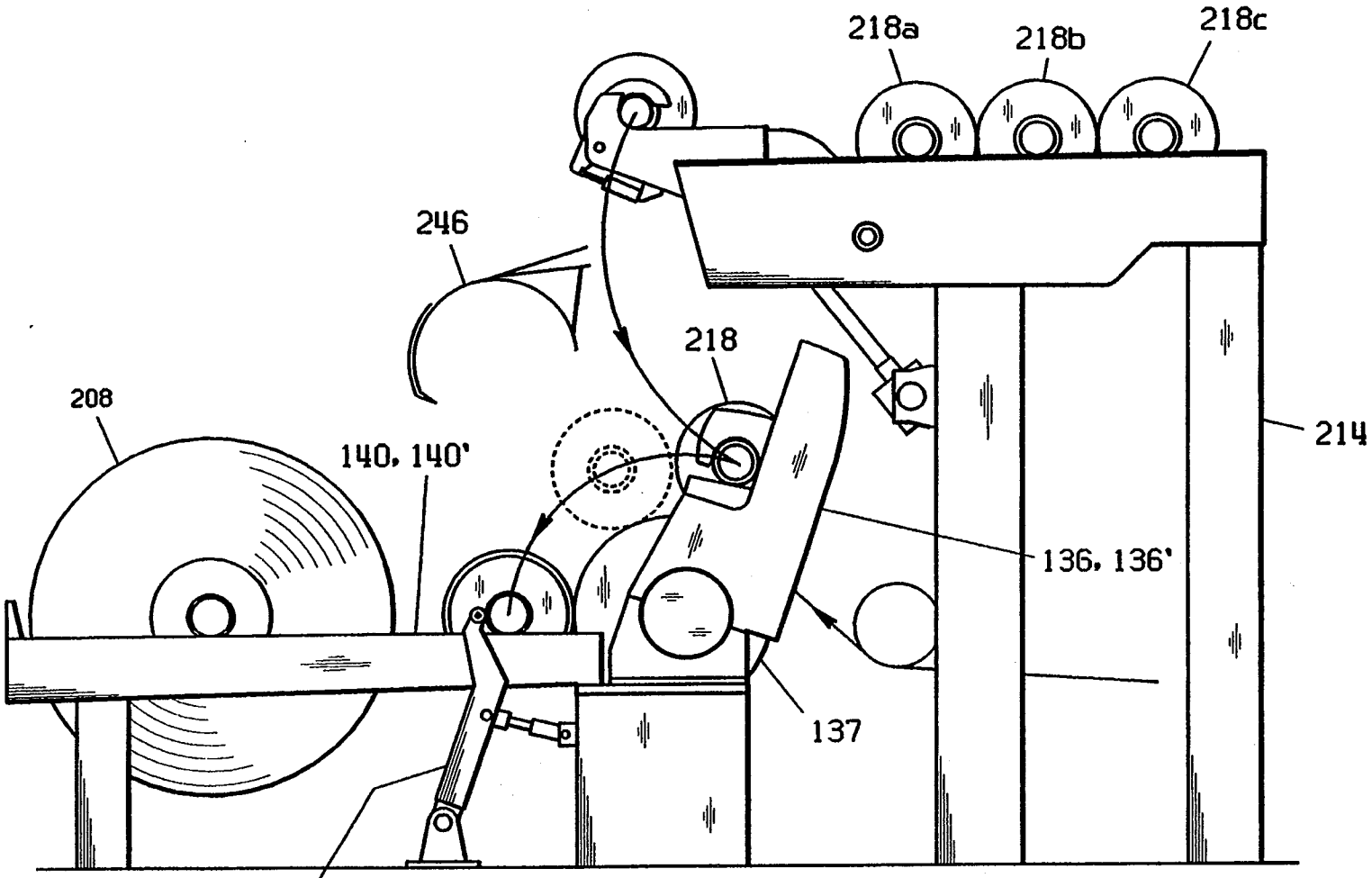
FIG. 12 ( PRIOR ART )
FIG. 12 is a side-elevational view of a prior art so-called Pope-type reel.

With reference to FIG. 12, a prior art Pope-type reeling apparatus is shown which utilizes a pair of primary arms 136 to initially receive a new reel spool and to bring it into nipping engagement with the support drum 137 after which the web is threaded into the nip to wrap the reel spool, and the reel spool on which the on-coming web is wound is moved downwardly over the surface of the support drum 137 in nipping engagement therewith after which it is deposited on horizontal rails 140, 140'. At this point, the secondary arms 138, 138' engage the reel spool and hold it into a nipping engagement with the support drum as the wound web roll increases in diameter.

Other elements, such as the wound web roll and empty reel spools, which are common to any type of reel apparatus, are designated with corresponding numerals, but in a 200 series. Thus, the wound web roll in the Pope reel is designated 208.

Thus, an improved web reeling apparatus has been shown and described which achieves the stated objects and which exhibits the stated features and advantages. Naturally, variations in the method and apparatus can be effected by those skilled in the art without departing from the spirit and scope of the appendant claims which measure the invention.

For example, the wound web roll has been described as being removed from the winding position after the next fresh reel spool has been started in the initial position. It is anticipated that the wound web roll could be removed from the winding position slightly before, simultaneously with, or slightly after, the newly started fresh reel spool is brought into nipping engagement with the support drum.

Also, the carriage support beams have been described as being pivotally mounted near the downstream end of the apparatus. However, it is clear that the carriage support beams could also be mounted to pivot near the upstream, or storage end of the apparatus and operate according to the same principle.

In another contemplated aspect of the invention which would fall within the inventive concept is that the preferred embodiment has been described wherein the fresh reel spool is moved downstream from the last location in the storage position at which point it is engaged by the carriages in the upstream portion of the initial position. Clearly, the upstream portion of the initial position could comprise the last location in the storage position. All that is required is that the fresh reel spool be available to be supported by the carriages as the drive motor engages the reel spool and that the reel spool is free to be rotated and brought up to operating speed without being interferred with by other reel spools in the storage area.

What is claimed is:

1. A method of reeling a traveling web into a wound web roll, comprising the steps:

moving a reel spool having a rotational axis to an initial position;

rotatively supporting the reel spool in its initial position;

applying torque to the reel spool in its initial position to rotate and drive the reel spool about its rotational axis;

engaging the reel spool in its initial position with a translationally movable support drum, rotatively driven about a rotational axis thereof, along a nip pressure line of contact therebetween;

bringing a traveling web onto the reel spool in its initial position to commence winding the web into a wound web roll thereon;

moving the web roll being wound along a substantially horizontal path from the initial position to a winding position while maintaining the web roll rotatively supported and in nipping engagement with the support drum;

the support drum maintains its engagement with the wound web roll in its winding position along a nip pressure line downstream of a vertical plane through the rotational axis of the support drum;

maintaining torque on the reel spool and nip pressure between the support drum and the wound web roll in the winding position at desired levels until the wound web roll reaches a predetermined diameter.

2. A method of reeling a traveling web into a wound web roll, as set forth in claim 1, wherein:

the support drum moves translationally substantially vertically to both engage the reel spool and maintain engagement with the wound web roll along a nip line of contact therebetween.

3. A method of reeling a traveling web into a wound web roll, as set forth in claim 1, wherein:

the support drum moves substantially vertically along an arcuate path to engage the wound web along a nip pressure line therebetween.

4. A method of reeling a traveling web into a wound web roll, as set forth in claim 1, including the further steps of:

controlling the wound web roll position along its horizontal support after it has moved to its winding position and is engaged with the support drum along a nip pressure line of contact;

moving the support drum substantially vertically to engage the wound web roll, and urging the support drum upwardly or downwardly to maintain the nip against the wound web roll in the winding position to provide the desired nip pressure as the wound web roll increases in diameter during the reeling process.

5. A method of reeling a traveling web into a wound web roll, as set forth in claim 1, further including the steps of:

providing first and second reel spool carriage means, independently supported and independently movable, for supporting corresponding first and second reel spools in their translational movement, said first reel spool carriage means supporting a first reel spool in its winding position while said second carriage means is available to move to engage a second reel spool for rotation in its initial position;

moving the first reel spool carriage means to a wound roll removal position when the web roll being wound has reached its desired diameter;

moving the second reel spool carriage means from its initial position to the winding position when the on-coming web has been started on the second reel spool and the wound web roll has been built up to a desired diameter.

6. A method of reeling a traveling web into a wound web roll, as set forth in claim 5, wherein:

the initial position comprises a span along the support of the reel spool, the span having an upstream portion for applying torque to rotate and drive the reel spool, and a downstream portion for engaging the reel spool in a nip with the support drum.

7. A method of reeling a traveling web into a wound web roll, comprising the steps:

moving a reel spool having a rotational axis to an initial position;

rotatively supporting the reel spool in its initial position;

applying torque to the reel spool in its initial position to rotate and drive the reel spool about its rotational axis;

engaging the reel spool in its initial position with a translationally movable support drum, rotatively driven about a rotational axis thereof, along a nip pressure line of contact therebetween;

bringing a traveling web onto the reel spool in its initial position to commence winding the web into a wound web roll thereon;

moving the web roll being wound along a substantially horizontal path from the initial position to a winding position while maintaining the web roll rotatively supported and in nipping engagement with the support drum;

maintaining the support drum in a fixed position after it has engaged the wound web roll along a nip pressure line of contact, and after the wound web roll has moved to its winding position;

maintaining torque on the reel spool;

moving the wound web roll in its winding position against the support drum and urging its against the support drum to provide the desired nip pressure as the wound web roll increase in diameter and moves translationally substantially horizontally during the reeling process.

8. A method of reeling a traveling web into a wound web roll, comprising the steps:

moving a reel spool having a rotational axis to an initial position;

rotatively supporting the reel spool in its initial position;

applying torque to the reel spool in its initial position to rotate and drive the reel spool about its rotational axis;

engaging the reel spool in its initial position with a translationally movable support drum, rotatively driven about a rotational axis thereof, along a nip pressure line of contact therebetween;

bringing a traveling web onto the reel spool in its initial position to commence winding the web into a wound web roll thereon;

moving the web roll being wound along a substantially horizontal path from the initial position to a winding position while maintaining the web roll rotatively supported and in nipping engagement with the support drum;

maintaining torque on the reel spool and nip pressure between the support drum and the wound web roll in the winding position at desired levels until the wound web roll reaches a predetermined diameter;

the wound web roll is selectively movable substantially horizontally translationally while it is rotatively supported in its winding position;

the support drum is selectively movable substantially vertically translationally while the wound web roll is rotatively supported in it winding position;

the movements of the wound web roll and the support drum are coordinated and controlled in such a manner as to move either the wound web roll or the support drum or both so as to provide a desired angle of the pressure nip line from a horizontal plane through the rotational axis of the wound web roll and a desired nip pressure at any time during the reeling process.

9. A method of reeling a traveling web into a wound web roll, comprising the steps:

moving a reel spool having a rotational axis to an initial position;

rotatively supporting the reel spool in its initial position;

applying torque to the reel spool in its initial position to rotate and drive the reel spool about its rotational axis;

engaging the reel spool in its initial position with a translationally movable support drum, rotatively driven about a rotational axis thereof, along a nip pressure line of contact therebetween;

bringing a traveling web onto the reel spool in its initial position to commence winding the web into a wound web roll thereon;

moving the web roll being wound along a substantially horizontal path from the initial position to a winding position while maintaining the web roll rotatively supported and in nipping engagement with the support drum;

maintaining torque on the reel spool and nip pressure between the support drum and the wound web roll in the winding position at desired levels until the wound web roll reaches a predetermined diameter.

measuring the nip pressure load and adjusting the loading force associated with either the support drum or the wound web roll accordingly to change the nip pressure load, as desired.

10. A method of reeling a traveling web into a wound web roll, as set forth in claim 9, further including the steps of:

providing reel spool support means for supporting one or more additional reel spools in substantially tandem array upstream of the reel spool in said initial position, the one or more reel spools being supported horizontally in a storage position in substantially the same horizontal plane as the reel spool in said initial position;

selectively engaging and positioning a new reel spool in said initial position from said one or more additional reel spools in storage position upon the movement of the proceeding reel spool from the initial position.

11. Apparatus for reeling a traveling web into a wound web roll on a reel spool comprising, in combination:

a frame;

rail means including a pair of spaced, substantially horizontally disposed parallel rails mounted on the frame for supporting a reel spool in an initial position and for substantially horizontal translational movement from the initial position to a winding position;

carriage means for engaging the reel spool, and for translationally supporting the reel spool parallel to the rails from the initial position to the winding position, the reel spool being rotatively supported in the carriage means;

support beam means mounted on the frame for supporting the carriage means for translational movement therealong;

carriage movement means mounted on the support beam means for moving the carriage means on the support beam means;

drive means for applying torque to the reel spool to rotatively drive the reel spool in its initial position, during its horizontal translational movement from its initial position to the winding position, and while it is in the winding position;

web turn-up means mounted on the frame for bringing a traveling web onto the reel spool to be wrapped thereon in its initial position to commence winding the traveling web into the wound web roll thereon;

support means including a translationally substantially vertically moveable support drum for engaging the reel spool in its initial position and for continuously engaging the wound web roll along a nip pressure line of contact therebetween from the initial position to the winding position during the reeling process;

drive means operatively connected to the support drum for rotatively driving the support drum.

12. Apparatus for reeling a traveling web into a wound web roll, as set forth in claim 11, wherein:

the support means comprises pivot apparatus for mounting the support drum for translational movement substantially vertically along an arcuate path of travel.

13. Apparatus for reeling a traveling web into a wound web roll, as set forth in claim 11, further including:

web tension means, including a roll over which the on-coming web travels, for providing tension to the on-coming web upstream of the support drum.

14. Apparatus for reeling a traveling web into a wound web roll, as set forth in claim 11, wherein:

the initial position comprises a span having an upstream portion for rotatively supporting a reel spool while the reel spool has torque applied to it to bring it up to speed, and a downstream portion where the rotating reel spool is nipped with the support drum for receiving the end of the traveling web to be wrapped thereon.

15. Apparatus for reeling a traveling web into a wound web roll, on a reel spool comprising, in combination:

a frame;

rail means including a pair of spaced, substantially horizontally disposed parallel rails mounted on the frame for supporting a reel spool in an initial position and for substantially horizontal translational movement from the initial position to a winding position;

carriage means for engaging the reel spool, and for translationally supporting the reel spool parallel to the rails from the initial position to the winding position, the reel spool being rotatively supported in the carriage means, the carriage means includes first and second carriage means;

the first carriage means for engaging the reel spool on which the web is being wound in the winding position, and the second carriage means for engaging a reel spool in the initial position;

support beam means mounted on the frame for supporting the carriage means for translational movement therealong the support beam means includes first and second reel spool carriage guide beam means for engaging and translationally supporting corresponding the first and second carriage means for translational movement therealong;

carriage movement means mounted on the support beam means for moving the carriage means on the support beam means, the carriage movement means includes actuators operatively associated with the first and second carriage guide beam means for reciprocatively moving the first and second carriage means;

drive means for applying torque to the reel spool to rotatively drive the reel spool in its initial position, during its horizontal translational movement from its initial position to the winding position, and while it is in the winding position;

web turn-up means mounted on the frame for bringing a traveling web onto the reel spool to be wrapped thereon in its initial position to commence winding the traveling web into the wound web roll thereon;

support means including a translationally substantially vertically moveable support drum for engaging the reel spool in its initial position and for continuously engaging the wound web roll along a nip pressure line of contact therebetween from the initial position to the winding position during the reeling process;

drive means operatively connected to the support drum for rotatively driving the support drum.

16. Apparatus for reeling a traveling web into a wound web roll, as set forth in claim 15, further including:

a storage position operatively associated with the rail means for storing a plurality of fresh reel spools;

and wherein the first and second carriage means are operable to engage a fresh reel spool from the storage position and to move the reel spool to the initial position and into nipping engagement with the support drum.

17. Apparatus for reeling a traveling web into a wound web roll, as set forth in claim 15, further including:

load cell means operatively mounted intermediate the frame and the first and second carriage guide beam means for measuring a nip pressure load force between the wound web roll and the support drum and for providing a signal which is a function of the load force;

control means for receiving the signal, the control means linked with the actuators associated with the carriage means supporting the web roll being wound for controlling the position of the wound web roll relative to the support drum.

18. Apparatus for reeling a traveling web into a wound web roll, as set forth in claim 15, further including:

load cell means operatively mounted intermediate the support drum and the support drum positioning frame means for measuring a nip pressure load force between the web roll being wound and the support drum and for providing a signal which is a function of the load force;

control means for receiving the signal, the control means linked with the support means for controlling the position of the support drum relative to the web roll being wound.

19. Apparatus for reeling a traveling web into a wound web roll, as set forth in claim 15, further including:

first load cells operatively mounted intermediate the frame and the first and second carriage guide beam means for measuring a first component of the nip pressure load force between the wound web roll and the support drum, and for providing a first signal which is a function of the load force;

first control means for receiving the first signal, the first control means linked with the actuators associated with the carriage means supporting the web roll being wound for controlling the position of the web roll relative to the support drum;

second load cell means operatively mounted intermediate the support drum and the support drum positioning frame means for measuring a second component of the nip pressure load force between the web roll being wound and the support drum, and for providing a second signal which is a function of the second component of the load force;

second control means for receiving the signal, the second control means linked with the support means for controlling the position of the support drum relative to web roll being wound.

20. Apparatus for reeling a traveling web into a wound web roll, as set forth in claim 15, wherein:

the first and second carriage guide beam means are pivotally attached to the frame near the downstream end of the rail means and extend upstream to at least the initial position, and are so constructed and arranged as to permit translational movement of the first and second carriage means in opposite directions to bypass one another, so as to guide the first carriage means for moving a first reel spool on which the web is being wound into a wound web roll downstream along the rails, and for moving the second carriage means in substantially the upstream direction to a location for subsequent movement upwardly to receive a second reel spool and to bring it into nipping engagement with the support drum.

21. A method of reeling a traveling web into a wound web roll, comprising the steps:

positioning a reel spool having a rotational axis to an initial position;

rotatively supporting the reel spool in its initial position;

applying torque to the reel spool in its initial position to rotate and drive the reel spool about its rotational axis;

engaging the reel spool in its initial position with a movable, rotatively driven support drum along a nip pressure line of contact therebetween;

bringing a traveling web onto the reel spool in its initial position along the nip pressure line to commence winding the web into a wound web roll thereon, the nip pressure line being located at a point beneath a horizontal plane through the rotational axis of the wound web roll so as to provide partial support by the driven support drum of the web roll being wound on the reel spool;

moving the reel spool downstream from the initial position along a substantially horizontal path while it is being rotated and winding the traveling web thereon while simultaneously moving the driven support drum to maintain nipping contact between the driven support drum and the reel spool with the web being wound thereon until the reel spool being wound reaches a winding position where the nip pressure line between it and the driven support drum is downstream of a vertical plane through the rotational axis of the support drum;

maintaining torque on the reel spool during the reeling process.

22. A method of reeling a traveling web into a wound web roll, comprising the steps:

positioning a reel spool having a rotational axis to an initial position;

rotatively supporting the reel spool in its initial position;

applying torque to the reel spool in its initial position to rotate and drive the reel spool about its rotational axis;

engaging the reel spool in its initial position with a substantially vertically movable, support drum, rotatively driven about a rotational axis thereof, along a nip pressure line of contact therebetween, the nip pressure line of contact being upstream of a vertical plane through the rotational axis of the support drum;

bringing a traveling web onto the reel spool in its initial position to commence winding the web into a wound web roll thereon;

moving the web roll being wound along a substantially horizontal path from the initial position to a winding position while maintaining it rotatively supported in nipping engagement with the driven support drum;

moving the support drum in association with the movement of the web roll being wound such as to produce a desired nip pressure between the driven support drum and wound web roll;

maintaining torque on the reel spool, and nip pressure between the driven support drum and the wound web roll in the winding position at desired levels until the wound web roll reaches a predetermined diameter.

23. A method of reeling a traveling web into a wound web roll, comprising the steps:

positioning a reel spool having a rotational axis to an initial position from a supply of reel spools in a storage position, the storage position being in substantially the same horizontal plane as the initial position;

rotatively supporting the reel spool in the initial position;

applying torque to the reel spool in its initial position to rotate and drive the reel spool about its rotational axis;

engaging the reel spool in its initial position with a substantially vertically movable, support drum, rotatively driven about a rotational axis thereof, along a nip pressure line of contact therebetween;

bringing a traveling web onto the reel spool in its initial position to commence winding the web into a wound web roll thereon, the nip pressure line of contact being upstream of a vertical plane through the rotational axis of the support drum;

moving the web roll being wound along a planar path from the initial position to a winding position while maintaining it rotatively supported and in nipping engagement with the driven support drum, the winding position being downstream of a vertical plane through the rotational axis of the support drum;

maintaining torque on the reel spool, and nip pressure between the driven support drum and the wound web roll in the winding position at desired levels until the wound web roll reaches a predetermined diameter.

* * * * *